US010215196B2

(12) United States Patent
Cheong

(10) Patent No.: US 10,215,196 B2
(45) Date of Patent: Feb. 26, 2019

(54) EJECTOR USING SWIRL FLOW

(71) Applicant: Samsung Electronics Co., Ltd., Suwon-si (KR)

(72) Inventor: Young-min Cheong, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 275 days.

(21) Appl. No.: 15/079,776

(22) Filed: Mar. 24, 2016

(65) Prior Publication Data

US 2017/0102010 A1 Apr. 13, 2017

(30) Foreign Application Priority Data

Oct. 12, 2015 (KR) ..... 10-2015-0142425

(51) Int. Cl.
*F04F 5/46* (2006.01)
*F04F 5/20* (2006.01)
(Continued)

(52) U.S. Cl.
CPC ..... *F04F 5/463* (2013.01); *F04F 5/20* (2013.01); *F04F 5/36* (2013.01); *F04F 5/42* (2013.01);
(Continued)

(58) Field of Classification Search
CPC ..... F25B 2341/0012; F25B 2341/0014; F25B 1/06; F04F 5/02; F04F 5/04; F04F 5/36;
(Continued)

(56) References Cited

U.S. PATENT DOCUMENTS 1,421,840 A * 7/1922 Schmidt ..... F04F 5/461 417/167
2,293,632 A * 8/1942 Sauer ..... F01N 3/05 181/259

(Continued)

FOREIGN PATENT DOCUMENTS

JP 2008-292396 12/2008
JP 4572910 11/2010

(Continued)

OTHER PUBLICATIONS

Communication with European Search Reported corresponding to European Patent Application No. EP 16161588, dated Feb. 10, 2017.
Abdalla, H. A., et al., Study of Swirling Turbulent Flow and Heat Transfer Characteristics in Conical Diffusers, Proceedings of ICFDP 8: Eighth International Congress of Fluid Dynamics & Propulsion, Dec. 14-17, 2006.

*Primary Examiner* — Kenneth J Hansen
(74) *Attorney, Agent, or Firm* — Staas & Halsey LLP

(57) ABSTRACT

An ejector for a vapor compression system using a swirl flow includes an ejector body comprising a main inlet into which a main flow in high pressure flows, a nozzle section in fluid communication with the main inlet, a mixing portion in fluid communication with the nozzle section, a diffuser in fluid communication with the mixing portion, and a discharge portion in fluid communication with the diffuser. A suction pipe is inserted in a center of the ejector body and includes a through-hole into which a suction flow in low pressure flows and a leading end portion of an outer surface of the pipe forms a plurality of inclined passages with the nozzle section of the ejector body. These passages allow the main flow to be moved to the mixing portion so as to form a swirl flow between the main flow and suction flow when mixed in the ejector.

17 Claims, 15 Drawing Sheets

(51) Int. Cl.

| | |
|---|---|
| ***F04F 5/36*** | (2006.01) |
| ***F04F 5/42*** | (2006.01) |
| ***F25B 1/06*** | (2006.01) |
| ***F25B 43/00*** | (2006.01) |
| ***F25B 41/00*** | (2006.01) |

(52) U.S. Cl.
CPC ..... *F25B 1/06* (2013.01); *F25B 41/00* (2013.01); *F25B 43/006* (2013.01); *F25B 2341/0012* (2013.01); *F25B 2500/01* (2013.01); *F25B 2500/18* (2013.01)

(58) Field of Classification Search
CPC ..... F04F 5/42; F04F 5/46; F04F 5/461462; F04F 5/463; B05B 7/10
USPC ..... 417/171, 194
See application file for complete search history.

(56) References Cited

U.S. PATENT DOCUMENTS

| | | | |
|---|---|---|---|
| 7,823,400 | B2 | 11/2010 | Oshitani et al. |
| 8,365,552 | B2 | 2/2013 | Brodie et al. |
| 2015/0033790 | A1 | 2/2015 | Yamada et al. |

FOREIGN PATENT DOCUMENTS

| | | | | |
|---|---|---|---|---|
| JP | 2014-148970 | | 8/2014 | |
| WO | WO 00/61948 | * | 10/2000 | ..... F04F 5/46 |
| WO | 2013002872 | A2 | 3/2013 | |
| WO | 2013003179 | A1 | 3/2013 | |

* cited by examiner

EJECTOR USING SWIRL FLOW

RELATED APPLICATION(S)

This application claims priority from Korean Patent Application No. 10-2015-0142425, filed Oct. 12, 2015 in the Korean Intellectual Property Office, the disclosure of which is incorporated herein by reference in its entirety.

BACKGROUND

The present disclosure relates to an ejector used in an air conditioner. More particularly, the present disclosure relates to an ejector configured to allow drawn refrigerant to form a swirl flow and an air conditioner having the same.

In general, an ejector may be used as a pressure reducing device for using in a vapor compression refrigeration cycle apparatus. Such an ejector has a nozzle section for decompressing refrigerant. The ejector is configured to draw a gaseous refrigerant discharged from an evaporator by a suction operation of the refrigerant ejected from the nozzle section. The ejector is configured so that the ejected refrigerant and the drawn refrigerant are mixed in a mixing portion, the pressure of the mixed refrigerant is increased in a diffuser, and then the mixed refrigerant is discharged to the outside of the ejector.

Accordingly, the refrigeration cycle apparatus having an ejector as the pressure reducing device (hereinafter, referred to as an ejector type refrigeration cycle) can reduce power consumption of the compressor by using the pressure increasing operation of the refrigerant that is generated in the diffuser of the ejector, and can raise coefficient of performance of the cycle than the refrigeration cycle apparatus using an expansion valve as the pressure reducing device.

The conventional ejector having a linear mixing portion needs to have a sufficient length of mixed portion to cause the main flow of a linear current to be mixed thoroughly with the suction flow. However, if the length of the mixing portion is increased, the total length of the ejector is also increased, so it is difficult to reduce the size of the refrigeration cycle apparatus.

Accordingly, in order to reduce the length of the ejector there is a need to reduce the length of the mixing portion. When forming a swirl flow in the nozzle section of the ejector, it is possible to reduce of the length of the mixed portion.

An example of the ejector using a swirl flow is disclosed in an U.S. Patent Application Publication No. 2015/0033790.

However, in the ejector disclosed in the above-mentioned patent application, while the swirl flow passes through the nozzle section, the velocity component in a swirling direction mostly disappears and the velocity component in the linear direction is increased. Accordingly, it is difficult to expect that the swirl flow is generated on the surface of a conical member so that reducing the length of the mixing portion is difficult.

SUMMARY

The present disclosure has been developed in order to overcome the above drawbacks and other problems associated with the conventional arrangement. An aspect of the present disclosure relates to an ejector the overall length of which can be reduced by causing a refrigerant flowing into the ejector to form a swirl flow in a mixing portion so as to reduce the length of the mixing portion.

Another aspect of the present disclosure relates to an ejector having nozzle grooves for generating a swirl flow that can be easily fabricated.

The above aspect and/or other feature of the present disclosure can substantially be achieved by providing an ejector using a swirl flow, which may include an ejector body comprising a main inlet into which a main flow in high pressure flows, a nozzle section in fluid communication with the main inlet, a mixing portion in fluid communication with the nozzle section, a diffuser in fluid communication with the mixing portion, and a discharge portion in fluid communication with the diffuser; and a suction pipe inserted in a center of the ejector body, the suction pipe including a through-hole into which a suction flow in low pressure flows, and a leading end portion an outer surface of which forms a plurality of inclined passages with the nozzle section of the ejector body, the plurality of inclined passages allowing the main flow to be moved to the mixing portion so as to form a swirl flow, wherein the main flow entering through the main inlet of the ejector body and the suction flow entering through the through-hole of the suction pipe are swirled and mixed in the mixing portion of the ejector body, and then are discharged outside through the diffuser and the discharge portion.

The leading end portion of the suction pipe may include a plurality of nozzle grooves formed on an outer surface of the leading end portion, and wherein, when the leading end portion of the suction pipe is inserted in the nozzle section of the ejector body, the plurality of nozzle grooves and an inner surface of the nozzle section form a plurality of nozzles, and the main flow is moved to the mixing portion through the plurality of nozzles.

The plurality of nozzle grooves may be formed to be inclined with respect to a center line of the suction pipe.

The suction pipe may be disposed to be movable back and forth with respect to the nozzle section of the ejector body.

A main flow receiving portion may be formed between the main inlet and the nozzle section of the ejector body, has a diameter larger than a diameter of the nozzle section, and is in fluid communication with the main inlet and the nozzle section, and wherein the suction pipe is movable in the main flow receiving portion.

The nozzle section of the ejector body may include a first slope portion formed at a portion of the nozzle section which is connected to the main flow receiving portion; and a second slope portion formed at a portion of the nozzle section which is connected to the mixing portion.

The suction pipe may include a leading inclined portion which is provided at a leading end of the suction pipe, and has a slope corresponding to the second slope portion of the nozzle section, and a middle inclined portion which is spaced apart from the leading inclined portion, and has a slope corresponding to the first slope portion of the nozzle section.

When the leading inclined portion of the suction pipe is in contact with the second slope portion of the nozzle section, the plurality of nozzle grooves may be blocked so that the main flow does not be moved to the mixing portion.

A diameter of the leading end portion of the suction pipe may be smaller than a diameter of other portions of the suction pipe.

The main inlet may be disposed eccentrically with respect to the center line of the ejector body.

The plurality of nozzle grooves may include three nozzle grooves.

According to another aspect of the present disclosure, an ejector using a swirl flow may include an ejector body comprising a main inlet into which a main flow flows, a nozzle section in fluid communication with the main inlet, a mixing portion in fluid communication with the nozzle section, a diffuser in fluid communication with the mixing portion, and a discharge portion in fluid communication with the diffuser; a suction pipe disposed to be movable in a lengthwise direction of the suction pipe in a center of the ejector body, the suction pipe including a through-hole into which a suction flow flows; and a plurality of nozzle grooves formed on an outer surface of a leading end portion of the suction pipe, the plurality of nozzle grooves that forms a plurality of passages through which the main flow flowing into the main inlet is moved to the mixing portion when the leading end portion of the suction pipe is inserted in the nozzle section of the ejector body, wherein the main flow entering through the main inlet of the ejector body is moved to the mixing portion through the plurality of nozzle grooves so as to form a swirl flow, and is mixed with the suction flow entering through the through-hole of the suction pipe.

The plurality of nozzle grooves may be formed to be inclined with respect to a center line of the suction pipe.

The ejector using a swirl flow may include a support member disposed integrally with the ejector body, and supporting movement of the suction pipe, wherein a main flow receiving portion may be formed between the support member and the nozzle section, may have a diameter larger than a diameter of the nozzle section, and may be in fluid communication with the main inlet and the nozzle section.

The nozzle section of the ejector body may include a first slope portion formed at a portion of the nozzle section which is connected to the main flow receiving portion; and a second slope portion formed at a portion of the nozzle section which is connected to the mixing portion.

The suction pipe may include a leading inclined portion which is provided at a leading end of the suction pipe, and has a slope corresponding to the second slope portion of the nozzle section, and a middle inclined portion which is spaced apart from the leading inclined portion, and has a slope corresponding to the first slope portion of the nozzle section.

The nozzle grooves may be formed on at least one of the leading inclined portion and the middle inclined portion of the leading end portion of the suction pipe.

The nozzle section, the mixing portion, the diffuser, and the through-hole of the suction pipe may be arranged in a straight line, and the main inlet may be formed such that the main flow flows in a tangential direction with respect to the suction pipe.

Other objects, advantages and salient features of the present disclosure will become apparent from the following detailed description, which, taken in conjunction with the annexed drawings, discloses preferred embodiments.

BRIEF DESCRIPTION OF THE DRAWINGS

These and/or other aspects and advantages of the present disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Hereinafter, certain exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

Figure 1:
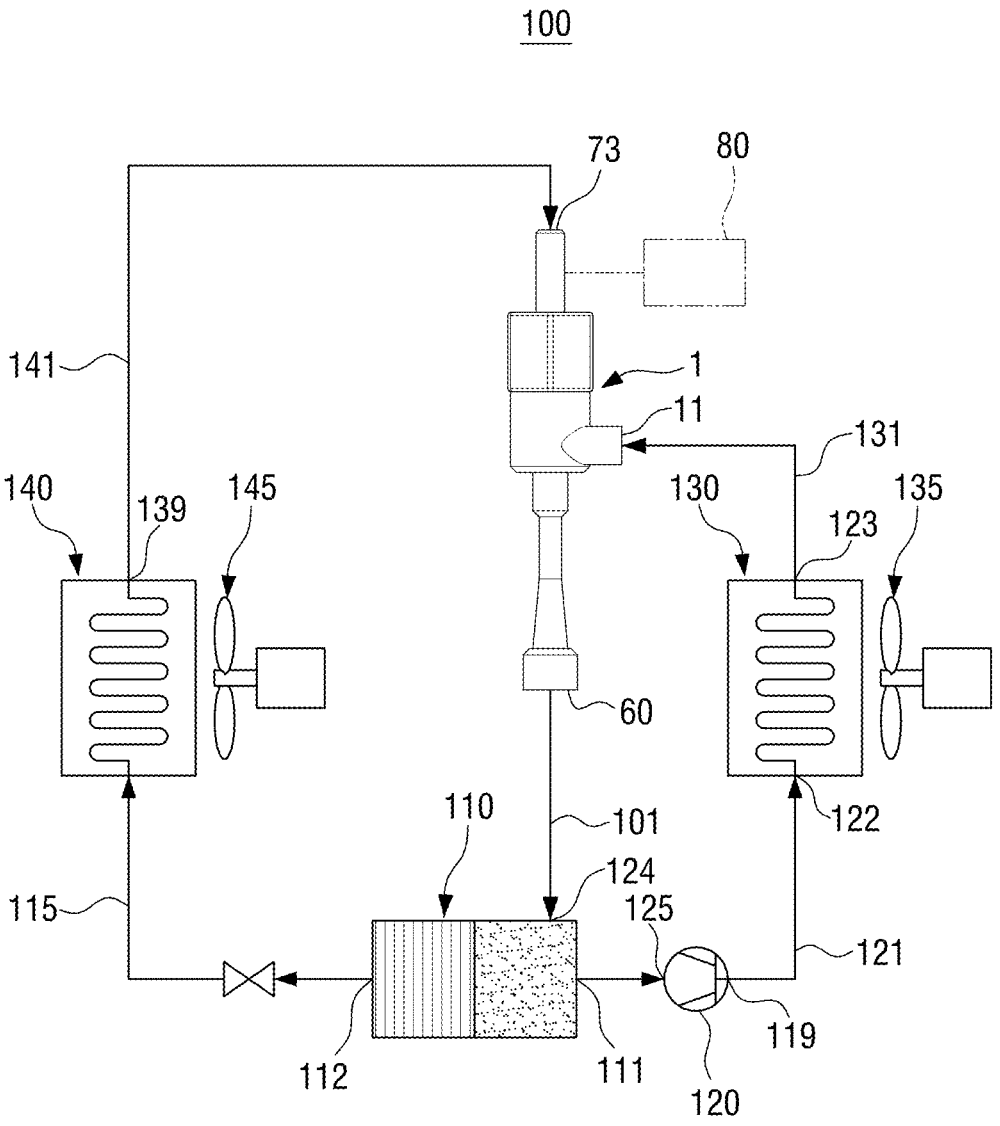
FIG. 1 is a diagram illustrating a vapor compression refrigeration cycle provided with an ejector using a swirl flow according to an embodiment of the present disclosure.

FIG. 1 is a diagram illustrating a vapor compression refrigeration cycle provided with an ejector using a swirl flow according to an embodiment of the present disclosure.

An ejector 1 using a swirl flow according to an embodiment of the present disclosure is used as a refrigerant pressure reducing device of a vapor compression refrigeration cycle apparatus 100 as illustrated in FIG. 1. Such a vapor compression refrigeration cycle apparatus 100 may be used in air conditioning apparatuses (not shown).

Referring to FIG. 1, a compressor 120 draws a refrigerant, pressurizes the drawn refrigerant in a high pressure, and discharges a high pressure refrigerant. A scroll type compressor, a vane type compressor and the like may be used as the compressor 120.

A discharge port 119 of the compressor 120 is connected to a refrigerant inlet 122 of a condenser 130 through a refrigerant line 121. The condenser 130 cools the high pressure refrigerant discharged from the compressor 120 by a cooling fan 135.

A discharge port 123 of the condenser 130 is connected to a first inlet 11 of the ejector 1 through a refrigerant line 131.

A discharge portion 60 of the ejector 1 is connected to an inlet 124 of a gas-liquid separator 110 through a refrigerant line 101. The gas-liquid separator 110 includes a liquid outlet 112 and a gas outlet 111. The gas outlet 111 of the gas-liquid separator 110 is connected to a refrigerant inlet 125 of the compressor 120, and the liquid outlet 112 is connected to an inlet of an evaporator 140 through a refrigerant line 115. While the refrigerant in liquid state is passing through the evaporator 140, the refrigerant in liquid state exchanges heat with air supplied by a fan 145 thereby turning the refrigerant into a gaseous state. The air cooled in the evaporator 140 is discharged by the fan 145.

An outlet 139 of the evaporator 140 is connected to a second inlet 73 of the ejector 1 through a refrigerant line 141.

The refrigerant lines 121 and 131 connecting the gas outlet 111 of the gas-liquid separator 110 and the first inlet 11 of the ejector 1 through the compressor 120 and the condenser 130 form a main loop of a refrigeration cycle. Also, the refrigerant lines 115 and 141 connecting the liquid outlet 112 of the gas-liquid separator 110 and the second inlet 73 of the ejector 1 through the evaporator 140 form an auxiliary loop of the refrigerant cycle.

Hereinafter, the ejector 1 using a swirl flow according to an embodiment of the present disclosure will be described in detail with reference to FIGS. 2 through 5.

Figure 2:
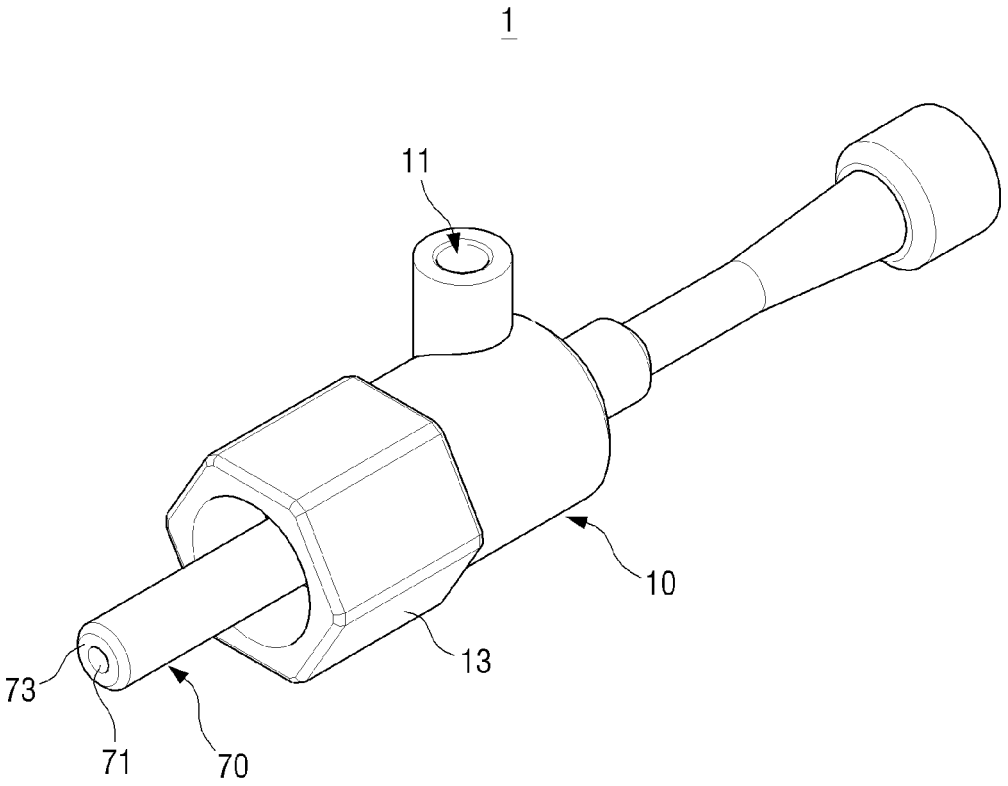
FIG. 2 is a perspective view illustrating an ejector using a swirl flow according to an embodiment of the present disclosure.
Figure 3:
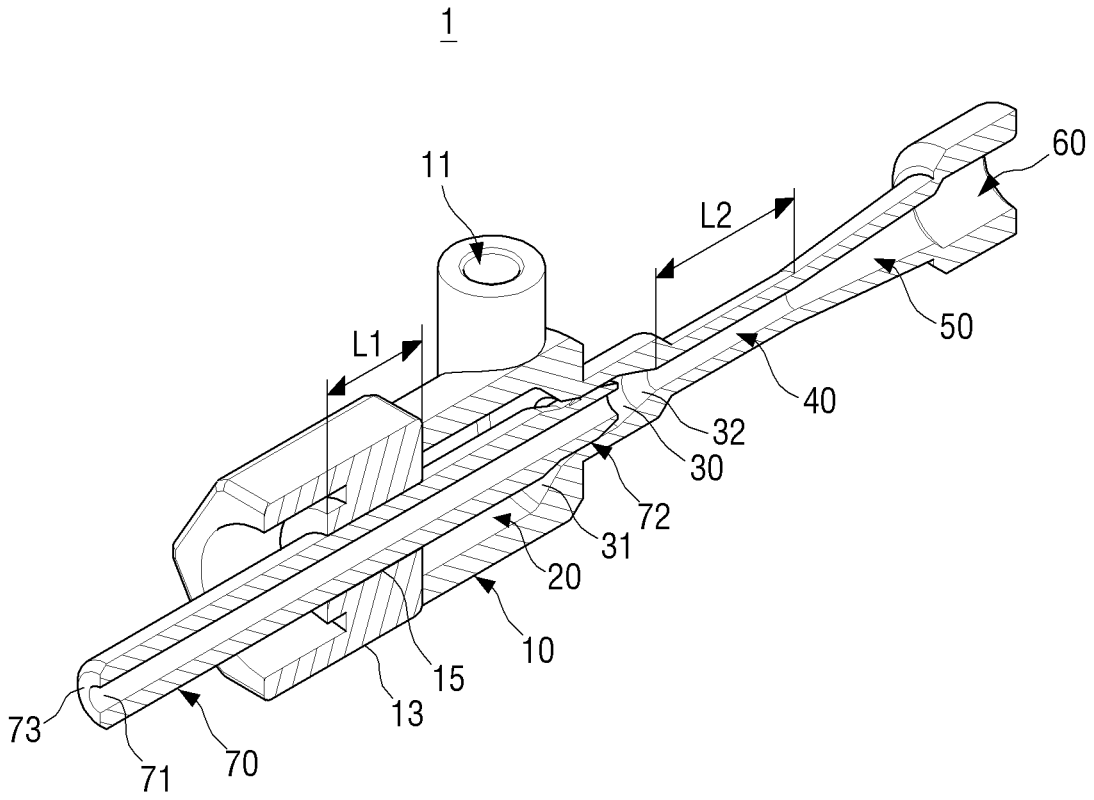
FIG. 3 is a sectional perspective view illustrating the ejector using a swirl flow of FIG. 2.
Figure 4:
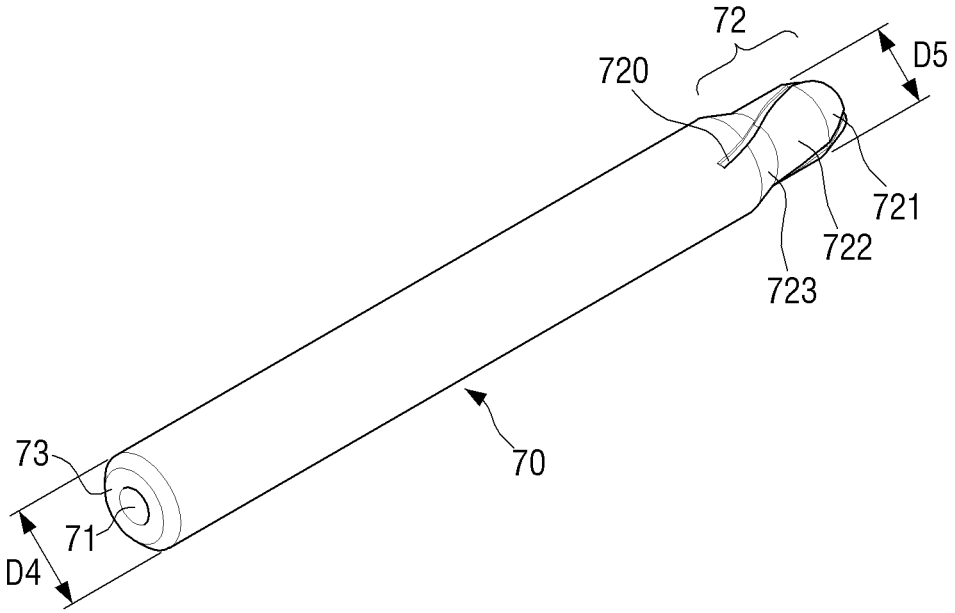
FIG. 4 is a perspective view illustrating a suction pipe of the ejector using a swirl flow of FIG. 2.
Figure 5:
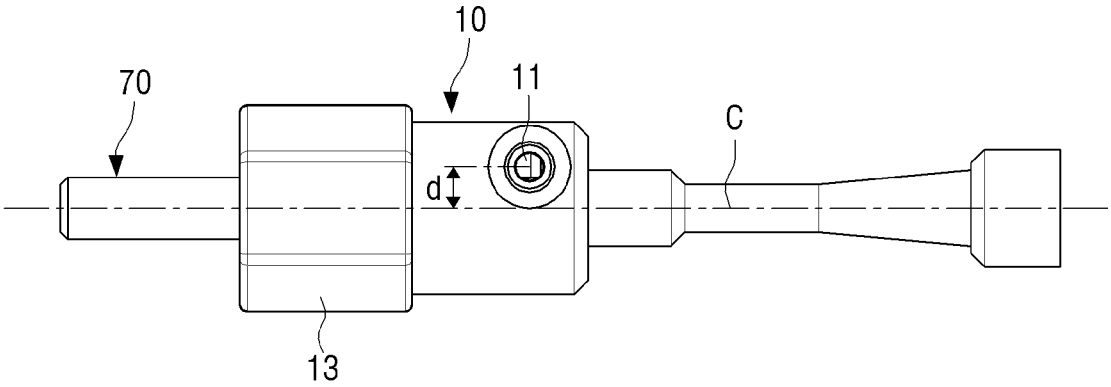
FIG. 5 is a plan view illustrating the ejector using a swirl flow of FIG. 2.

FIG. 2 is a perspective view illustrating an ejector using a swirl flow according to an embodiment of the present disclosure. FIG. 3 is a sectional perspective view illustrating the ejector using a swirl flow of FIG. 2. FIG. 4 is a perspective view illustrating a suction pipe of the ejector using a swirl flow of FIG. 2. FIG. 5 is a plan view illustrating the ejector using a swirl flow of FIG. 2.

Referring to FIGS. 2 through 5, the ejector 1 using a swirl flow according to an embodiment of the present disclosure may include an ejector body 10 and a suction pipe 70.

The ejector body 10 may include a main inlet, the first inlet 11, a main flow receiving portion 20, a nozzle section 30, a mixing portion 40, a diffuser 50, and a discharge portion 60. The main flow receiving portion 20, the nozzle section 30, the mixing portion 40, the diffuser 50, and the discharge portion 60 are arranged in a straight line along a center line C of the ejector body 10.

The main inlet, the first inlet 11 forms an inlet into which the main flow of the refrigerant flows. The refrigerant line 131 connected to the discharge port 123 of the condenser 130 forming the main loop is connected to the main inlet, the first inlet 11. Here, the main flow refers to a refrigerant flow in high pressure that is discharged from the condenser 130 and then flows into the ejector 1. The main inlet, the first inlet 11 is formed in a side surface of the ejector body 10 and is spaced apart from the nozzle section 30. Also, the main inlet, the first inlet 11 is spaced a predetermined distance d apart from a center line C of the ejector body 10. In other words, a center of the main inlet, the first inlet 11 is deviated from the center line C of the ejector body 10 by the predetermined distance d as illustrated in FIG. 5. Accordingly, the main flow flowing into the main inlet, the first inlet 11, enters the main flow receiving portion 20 in a tangential direction with respect to the suction pipe 70 disposed in the center of the ejector body 10, thereby not colliding with the suction pipe 70.

The main flow receiving portion 20 is formed directly below the main inlet, the first inlet 11. The main flow receiving portion 20 is formed so that the main flow flowing into the main inlet, the first inlet 11, stays before moving to the nozzle section 30. The main flow receiving portion 20 is formed in a cylindrical space, and a diameter D1 of the main flow receiving portion 20 is larger than an outer diameter D4 of the suction pipe 70 (see FIG. 8).

The rear end of the ejector body 10 is provided with a support member 13 for supporting the suction pipe 70. The support member 13 is provided with a through-hole 15 corresponding to the outer diameter D4 of the suction pipe 70. Accordingly, the suction pipe 70 is inserted in the through-hole 15 of the support member 13. When the suction pipe 70 is disposed to be movable in a straight line with respect to the ejector body 10, the movement of the suction pipe 70 may be guided by the support member 13. The length L1 of the through-hole 15 of the support member 13 may be determined so as to stably support the linear movement of the suction pipe 70. Also, the support member 13 is disposed on the opposite side of the nozzle section 30 and forms the main flow receiving portion 20.

Figure 8:
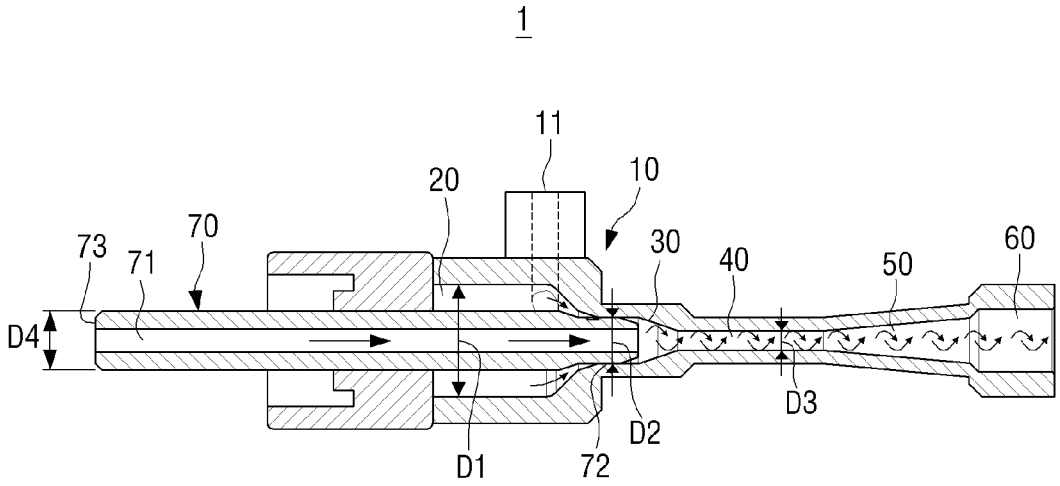
FIG. 8 is a cross-sectional view for explaining a main flow and a suction flow in an ejector using a swirl flow according to an embodiment of the present disclosure.

The nozzle section 30 is provided on the opposite side of the support member 13, and an inner surface of the nozzle section 30 forms a plurality of nozzles forming a swirl flow of the main flow with a plurality of nozzle grooves 720 of the suction pipe 70. The nozzle section 30 is formed in a cylindrical space, and a diameter D2 (as shown in FIG. 8) of the nozzle section 30 is formed in a size corresponding to a diameter D5 of a leading end portion 72 of the suction pipe 70. Also, the diameter D2 of the nozzle section 30 is smaller than a diameter D1 (as shown in FIG. 8) of the main flow receiving portion 20.

A first slope portion 31 and a second slope portion 32 are provided in the opposite ends of the nozzle section 30. In detail, the first slope portion 31 is formed in a portion of the nozzle section 30 connecting to the main flow receiving portion 20, and the second slope portion 32 is formed in a portion of the nozzle section 30 connecting to the mixing portion 40. Since the diameter D1 of the main flow receiving portion 20 is larger than the diameter D2 of the nozzle section 30, the first slope portion 31 is formed in a substantially truncated conical shape. At this time, the bottom of the truncated cone faces the main flow receiving portion 20, and the top of the truncated cone faces the nozzle section 30 so that the first slope portion 31 is formed in a shape converging toward the nozzle section 30.

Since the diameter D2 of the nozzle section 30 is larger than the diameter D3 (as shown in FIG. 8) of the mixing portion 40, the second slope portion 32 is formed in a substantially truncated conical shape. At this time, the bottom of the truncated cone faces the nozzle section 30, and the top of the truncated cone faces the mixing portion 40 so that the second slope portion 32 is formed in a shape converging toward the mixing portion 40.

The mixing portion 40 is where a suction flow in low pressure being drawn through the suction pipe 70 is mixed with the main flow flowing through the nozzle section 30, and is formed in a cylindrical space. Here, the suction flow refers to a gaseous refrigerant flow in low pressure discharged from the evaporator 140 that is drawn through the suction pipe 70 by the injection of the main flow. The diameter D3 of the mixing portion 40 is smaller than the diameter D2 of the nozzle section 30. Since the main flow flowing through the nozzle section 30 forms a swirl flow, a low pressure is generated in the center of the swirl flow so that the suction flow is drawn into the mixing portion 40 through the suction pipe 70. Since swirling of the main flow in the mixing portion 40 accelerates the mixing and energy exchange between the main flow and the suction flow, the length L2 (as shown in FIG. 3) of the mixing portion 40 may be shorter than the length of the mixing portion of the conventional ejector mixing the main flow flowing linearly and the suction flow.

The diffuser 50 functions as a pressure increasing portion that increases a pressure of the mixed refrigerant by reducing the velocity energy of the refrigerant mixed in the mixing portion 40. The diffuser 50 is formed in a shape of a truncated cone a diameter of which is increasingly larger toward the discharge portion 60. In other words, the diffuser 50 is formed in a shape diverging towards the discharge portion 60.

The discharge portion 60 is provided at one end of the diffuser 50, and is connected to the inlet 124 of the gas-liquid separator 110.

The suction pipe 70 is disposed in the lengthwise direction of the ejector body 10 in the center of the ejector body 10, and is formed in a hollow circular pipe. A leading end portion 72 of the suction pipe 70 is formed in a shape corresponding to the nozzle section 30 of the ejector body 10. A rear end of the suction pipe 70 forms the second inlet 73 of the ejector 1, namely, the suction inlet into which the refrigerant in a gas phase discharged from the evaporator 140 flows.

Referring to FIG. 4, the outer diameter D5 (as shown in FIG. 4) of the leading end portion 72 of the suction pipe 70 is formed to be smaller than the outer diameter D4 of the other portion of the suction pipe 70. The outer diameter D5 of the leading end portion 72 of the suction pipe 70 is determined by a size corresponding to the diameter D2 of the nozzle section 30 of the ejector body 10. For example, the outer diameter D5 of the leading end portion 72 of the suction pipe 70 may be determined so that the leading end portion 72 of the suction pipe 70 is inserted in the nozzle section 30 of the ejector body 10 and the main flow does not pass through between the leading end portion 72 of the suction pipe 70 and the nozzle section 30 of the ejector body 10.

Also, the leading end portion 72 of the suction pipe 70 may be formed to have two inclined portions. In detail, the leading end portion 72 of the suction pipe 70 may include a leading inclined portion 721 which is provided at a leading end of the suction pipe 70 and has a slope corresponding to the second slope portion 32 of the nozzle section 30 of the ejector body 10, and a middle inclined portion 723 which is spaced apart from the leading inclined portion 721 and has a slope corresponding to the first slope portion 31 of the nozzle section 30. A cylindrical portion 722 forming a nozzle with the nozzle section 30 of the ejector body 10 is provided between the leading inclined portion 721 and the middle inclined portion 723 of the leading end portion 72.

Figure 6A:
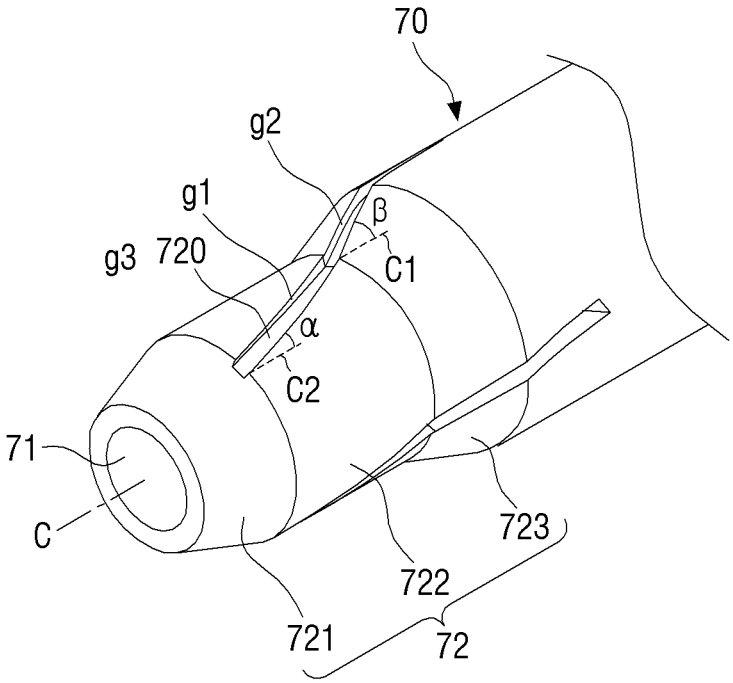
FIGS. 6A and 6B are a partial perspective view illustrating a plurality of nozzle grooves formed on the suction pipe of FIG. 2.

A plurality of nozzle grooves 720 are formed on the surface of the leading end portion 72 of the suction pipe 70. The plurality of nozzle grooves 720 is formed to be inclined at a predetermined angle with respect to the center line C of the ejector body 10. In detail, as illustrated in FIG. 6A, each of the nozzle grooves 720 is formed to be inclined at a predetermined angle in the horizontal direction with respect to the center line C of the ejector body 10, namely, the center line C of the suction pipe 70 as a swirl angle $\alpha$, and to be inclined at a predetermined angle in the vertical direction with respect to the center line C of the suction pipe 70 as an incident angle $\beta$. Accordingly, the main flow passing through the plurality of nozzle grooves 720 forms the swirl flow.

The swirl angle $\alpha$ refers to an angle between the nozzle groove 720 formed on the leading end portion 72 of the suction pipe 70 and an imaginary straight line C2 that passes through the leading end of the nozzle groove 720 and is parallel to the center line C of the suction pipe 70. The incident angle $\beta$ refers to an angle between a portion g2 of the nozzle groove 720 formed on the middle inclined portion 723 of the suction pipe 70 and an imaginary straight line C1 that passes through the leading end of the portion g2 of the nozzle groove 720 formed on the middle inclined portion 723 and is parallel to the center line C of the suction pipe 70.

Accordingly, since when the leading end portion 72 of the suction pipe 70 is inserted into the nozzle section 30 of the ejector body 10, the plurality of nozzle grooves 720 of the suction pipe 70 and the inner surface of the nozzle section 30 of the ejector body 10 form a plurality of passages, namely, a plurality of nozzles through which the main flow passes, the main flow may be ejected to the mixing portion 40 through the plurality of nozzles.

Figure 6B:
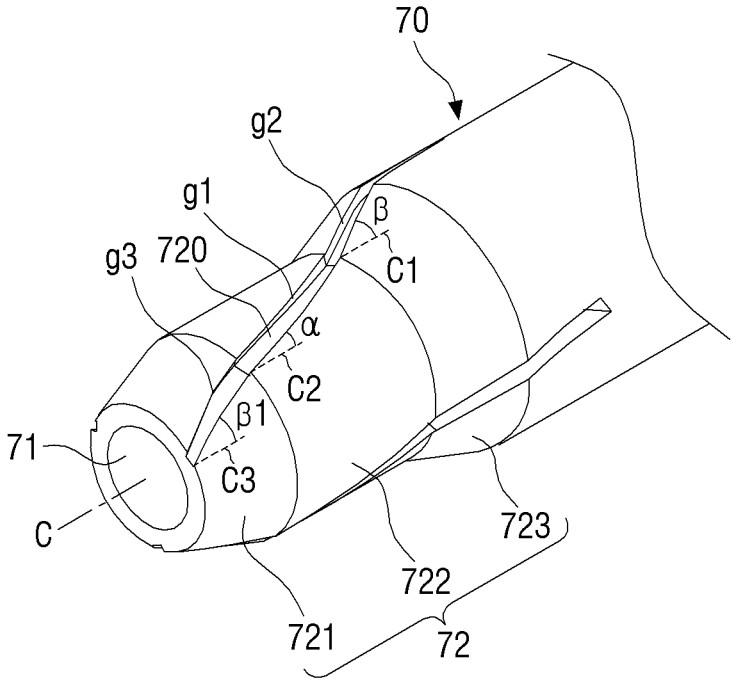

As another embodiment of the present disclosure, the plurality of nozzle grooves 720 of the leading end portion 72 of the suction pipe 70 may be formed as illustrated in FIG. 6B. The nozzle grooves 720 as illustrated in FIG. 6B are formed till the leading inclined portion 721 of the suction pipe 70. Accordingly, the nozzle grooves 720 as illustrated in FIG. 6B may have a second incident angle $\beta$ in addition to the swirl angle $\alpha$ and the incident angle $\beta$ which the nozzle grooves 720 of FIG. 6A as described above have. At this time, the second incident angle $\beta$ refers to an angle between a portion g3 of the nozzle groove 720 formed on the leading inclined portion 721 of the suction pipe 70 and a imaginary straight line C3 that passes through the leading end of the portion g3 of the nozzle groove 720 formed on the leading inclined portion 721 and is parallel to the center line C of the suction pipe 70.

The plurality of nozzle grooves 720 may be formed so that when the leading inclined portion 721 of the suction pipe 70 is in contact with the second slope portion 32 of the nozzle section 30 of the ejector body 10, the plurality of nozzle grooves 720 is blocked to prevent the main flow from being moved to the mixing portion 40.

Figure 7:
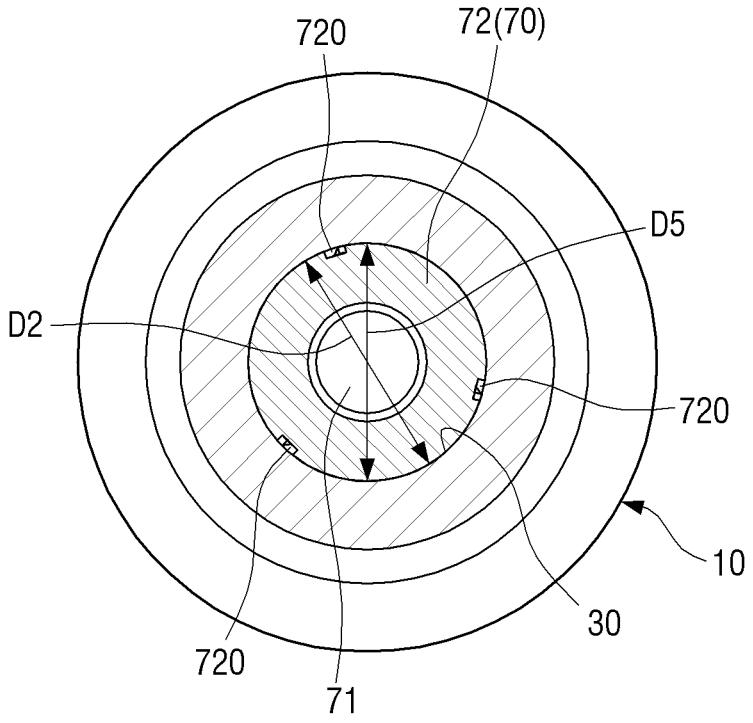
FIG. 7 is a sectional view illustrating the ejector using a swirl flow taken along a line 7-7 in FIG. 2.

Also, the plurality of nozzle grooves 720 may include two or more nozzle grooves 720. The ejector 1 according to an embodiment of the present disclosure has three nozzle grooves 720. Accordingly, when the leading end portion 72 of the suction pipe 70 is inserted into the nozzle section 30 of the ejector body 10, the tops of the nozzle grooves 720 of the leading end portion 72 are covered by the inner surface of the nozzle section 30 of the ejector body 10 so that three nozzles are formed between the leading end portion 72 of the suction pipe 70 and the nozzle section 30 of the ejector body 10 as illustrated in FIG. 7. Accordingly, the main flow in the main flow receiving portion 20 is moved to the mixing portion 40 through the three nozzles. The cross-section of the nozzle groove 720 may be formed in a variety of shapes. For example, the cross-section of the nozzle grooves 720 may be formed in a rectangular shape, a semi-circular shape, etc.

In the ejector 1 using a swirl flow according to an embodiment of the present disclosure as described above, the nozzles through which the main flow passes are formed by processing the nozzle grooves 720 on the surface of the leading end portion 72 of the suction pipe 70. Therefore, processing of the nozzles is easy compared to the conventional ejector that forms nozzles by processing nozzle grooves inside the ejector body 10. In the ejector 1 according to an embodiment of the present disclosure, since the nozzle grooves 720 are formed on the surface of the leading end portion 72 of the suction pipe 70, the nozzle may be formed in a variety of shapes, and to process the plurality of nozzle grooves 720 is also easy.

The suction pipe 70 may be fixed in a certain position with respect to the ejector body 10. However, as another embodiment, the suction pipe 70 may be disposed to be movable with respect to the ejector body 10 so as to adjust the flow pressure of the main flow depending on external conditions.

In this case, the suction pipe 70 is moved linearly in the lengthwise direction of the ejector body 10 along the center line C of the ejector body 10 so that the leading end of the suction pipe 70 is moved closely to or away from the nozzle section 30. In other words, the suction pipe 70 is disposed to be movable back and forth with respect to the nozzle section 30 of the ejector body 10.

At this time, the suction pipe 70 is moved through the main flow receiving portion 20 of the ejector body 10.

For this, a drive unit 80 (see FIG. 1) capable of moving the suction pipe 70 linearly in the direction of the center line C of the ejector body 10 is provided at the rear end of the suction pipe 70. The drive unit 80 may be implemented by a motor and a linear movement mechanism. The drive unit 80 may use a variety of structures that can move the suction pipe 70 linearly.

As described above, if the suction pipe 70 is formed to be movable with respect to the ejector body 10, the length of the plurality of passages, namely, the plurality of nozzles formed by the plurality of nozzle grooves 720 of the suction pipe 70 and the inner surface of the nozzle section 30 of the ejector body 10 may be adjusted so that the flow pressure of the main flow flowing-in through the plurality of passages may be adjusted.

Hereinafter, operation of the ejector 1 using a swirl flow according to an embodiment of the present disclosure will be described in detail with reference to FIGS. 1, 3, and 8.

The liquid refrigerant in high pressure flows from the condenser 130 into the first inlet 11 of the ejector 1. The liquid refrigerant in high pressure forms a main flow flowing into the first inlet 11 of the ejector 1. The main flow flowing into the first inlet 11 passes through the main flow receiving portion 20, and then is ejected into the mixing portion 40 through the plurality of nozzle grooves 720 formed between the nozzle section 30 of the ejector body 10 and the leading end portion 72 of the suction pipe 70.

Figure 10:
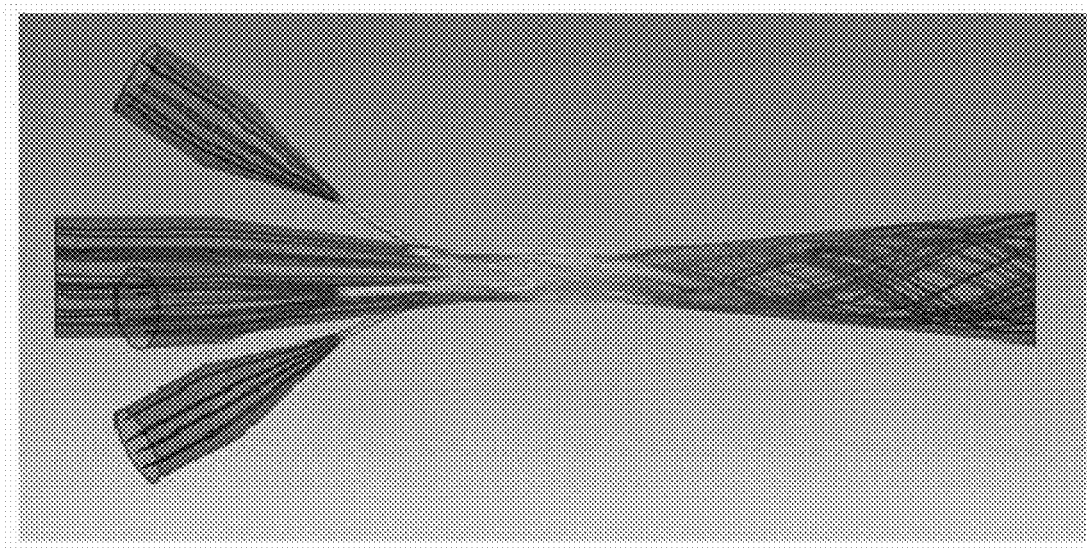
FIG. 10 is an image illustrating a computer simulation showing swirl flows formed inside an ejector using a swirl flow according to an embodiment of the present disclosure.

At this time, since the plurality of nozzle grooves 720 formed on the leading end portion 72 of the suction pipe 70 is inclined with respect to the center line C of the ejector body 10, the main flow flowing into the mixing portion 40 through the plurality of nozzle grooves 720 forms a swirl flow. An example of the swirl flow formed inside the ejector body 10 is illustrated in FIG. 10. FIG. 10 is an image illustrating a computer simulation of the swirl flows generated in an ejector 1 using a swirl flow according to an embodiment of the present disclosure.

Figure 11:
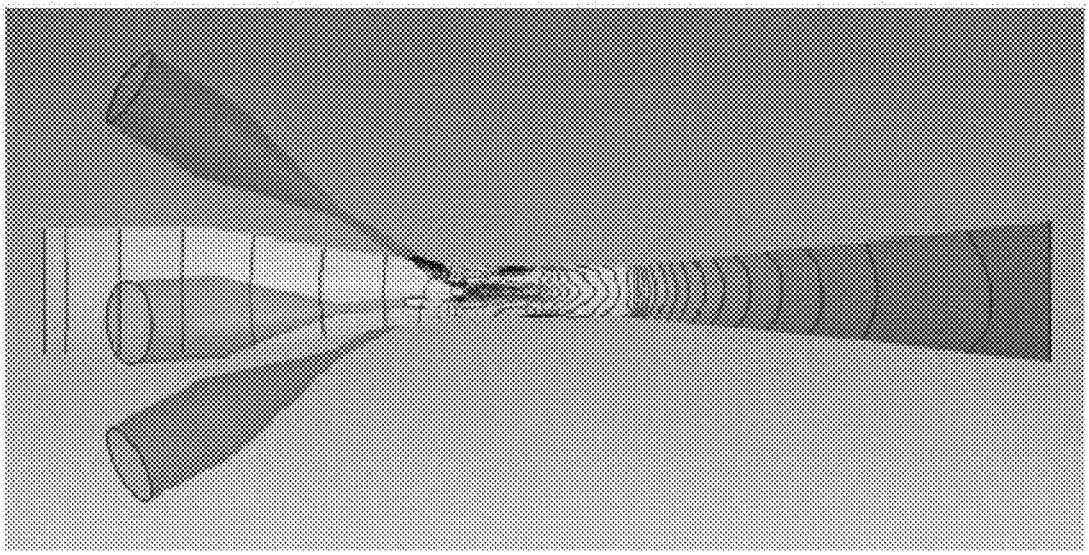
FIG. 11 is an image illustrating a computer simulation showing a pressure distribution inside an ejector using a swirl flow according to an embodiment of the present disclosure.

At this time, since the center of the swirl flow formed by the main flow becomes a low pressure, the gaseous refrigerant in low pressure is drawn from the evaporator 140 into the mixing portion 40 of the ejector body 10 through the suction pipe 70. The gaseous refrigerant drawn through the suction pipe 70 forms the suction flow. An example of the pressure distribution inside the ejector body 10 is illustrated in FIG. 11. FIG. 11 is an image illustrating a computer simulation of pressure distribution inside an ejector 1 using a swirl flow according to an embodiment of the present disclosure when the ejector 1 operates.

The suction flow drawn through the suction pipe 70 is mixed with the plurality of main flows in the mixing portion 40 of the ejector body 10. The plurality of main flows is ejected into the mixing portion 40 through the plurality of nozzle grooves 720, and is swirled in the mixing portion 40. At this time, since the plurality of main flows is swirled in the mixing portion 40, the main flows are well mixed with the suction flow drawn through the suction pipe 70, and energy exchange is promoted. As a result, mixing efficiency of the main flow and the suction flow is increased.

A mixed flow formed of the main flow and the suction flow mixed in the mixing portion 40 of the ejector body 10 is passed through the diffuser 50, and then is discharged outside the ejector 1 through the discharge portion 60. When the mixed flow passes through the diffuser 50, the pressure of the mixed flow, namely, mixed refrigerant is increased, and the axial velocity of the mixed flow near the center line is reduced.

As described above, in the ejector 1 using a swirl flow according to an embodiment of the present disclosure, since the main flow is swirled in the mixing portion 40 of the ejector body 10, although the length L2 (as shown in FIG. 3) of the mixing portion 40 is shortened, the main flow and the suction flow may be mixed effectively.

Also, in the ejector 1 using a swirl flow according to an embodiment of the present disclosure, there may be an optimal value for the length L2 of the mixing portion 40. When the length L2 of the mixing portion 40 is too short or too long, the pressure of the mixed flow discharged from the diffuser 50 is dropped.

Figure 12:
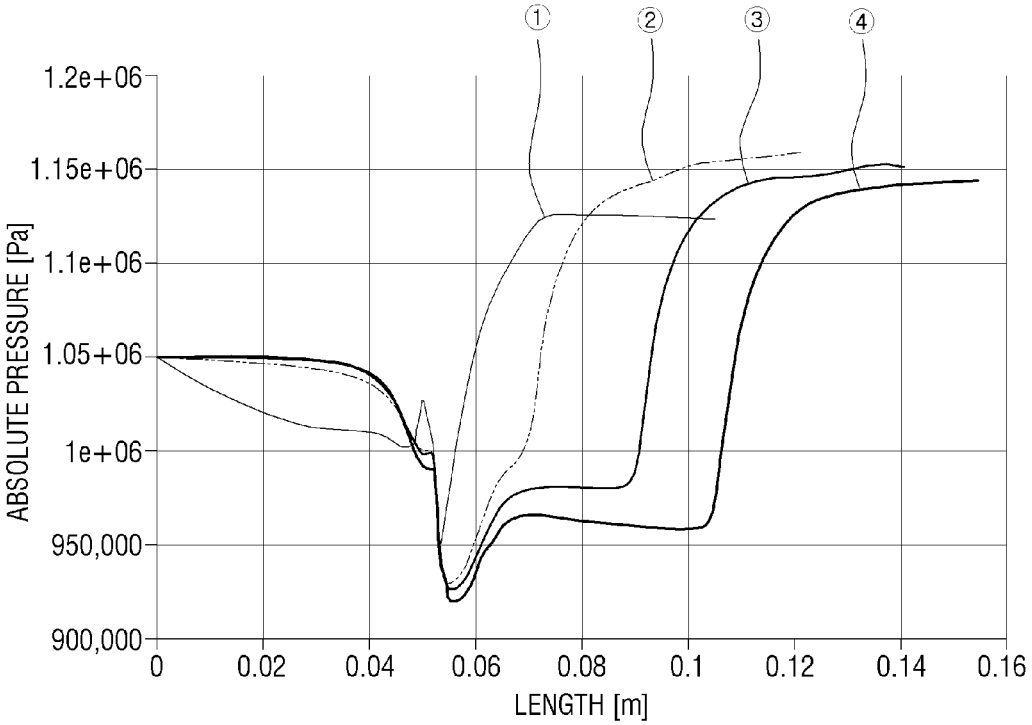
FIG. 12 is a graph illustrating changes in pressure of a discharged mixed refrigerant depending on changes in a length of a mixing portion in an ejector using a swirl flow according to an embodiment of the present disclosure.

A result of measuring change in pressure of the mixed flow being discharged from the diffuser 50 according to the length L2 of the mixing portion 40 is illustrated in FIG. 12. FIG. 12 is a graph illustrating the measurement of the pressure of the mixed flow being discharged from the diffuser 50 when the length of each of the main flow receiving portion 20, the nozzle section 30, the diffuser 50, and the discharge portion 60 of the ejector body 10 remains the same, and the length L2 of only the mixing portion 40 is changed. In FIG. 12, the length of X-axis represents the length of the entire ejector.

Referring to FIG. 12, a line ① indicates a case in which the length L2 of the mixing portion 40 is about 5 mm, and it can be seen that the pressure of the mixed flow discharged from the diffuser 50 rises about 75.8 kPa, i.e., about 7.2%. A line ② indicates a case in which the length L2 of the mixing portion 40 is about 20 mm, and it can be seen that the pressure of the mixed flow discharged from the diffuser 50 rises about 109.3 kPa, i.e., about 10.4%. A line ③ indicates a case in which the length L2 of the mixing portion 40 is about 40 mm, and it can be seen that the pressure of the mixed flow discharged from the diffuser 50 rises about 104.6 kPa, i.e., about 9.96%. A ④ indicates a case in which the length L2 of the mixing portion 40 is about 55 mm, and it can be seen that the pressure of the mixed flow discharged from the diffuser 50 rises about 97.9 kPa, i.e., about 9.33%.

As described above, in the ejector 1 using a swirl flow according to an embodiment of the present disclosure, it can be seen that when the length L2 of the mixing portion 40 is about 20 mm, the pressure of the mixed flow discharged from the diffuser rises to a maximum. Also, if the length L2 of the mixing portion 40 is formed to be shorter than 20 mm in order to shorten the length of the ejector 1, it can be seen that the pressure rise of the mixed flow discharged from the diffuser is reduced.

The refrigerant of the mixed flow discharged from the discharge portion 60 of the ejector 1 flows into the gas-liquid separator 110. The refrigerant flowed into the gas-liquid separator 110 is divided into a refrigerant in a gas state and a refrigerant in a liquid state, and the refrigerant in the liquid state moves to the evaporator 140 through the liquid outlet 112 of the gas-liquid separator 110. Also, the refrigerant in the gas state moves to the compressor 120 through the gas outlet 111 of the gas-liquid separator 110.

On the other hand, the suction pipe 70 may be disposed fixedly in a certain position with respect to the ejector body 10. However, in another embodiment of the present disclosure, the suction pipe 70 may be disposed to be moved linearly with respect to the ejector body 10. When the suction pipe 70 is movable with respect to the ejector body 10, a controller (not illustrated) for controlling the refrigeration cycle apparatus may control the flow pressure of the main flow by adjusting the position of the suction pipe 70.

Hereinafter, when the suction pipe 70 is movable with respect to the ejector body 10, a pressure drop in the nozzle section 30 of the ejector body 10 will be described with reference to FIGS. 9A, 9B, and 9C.

Figure 9A:
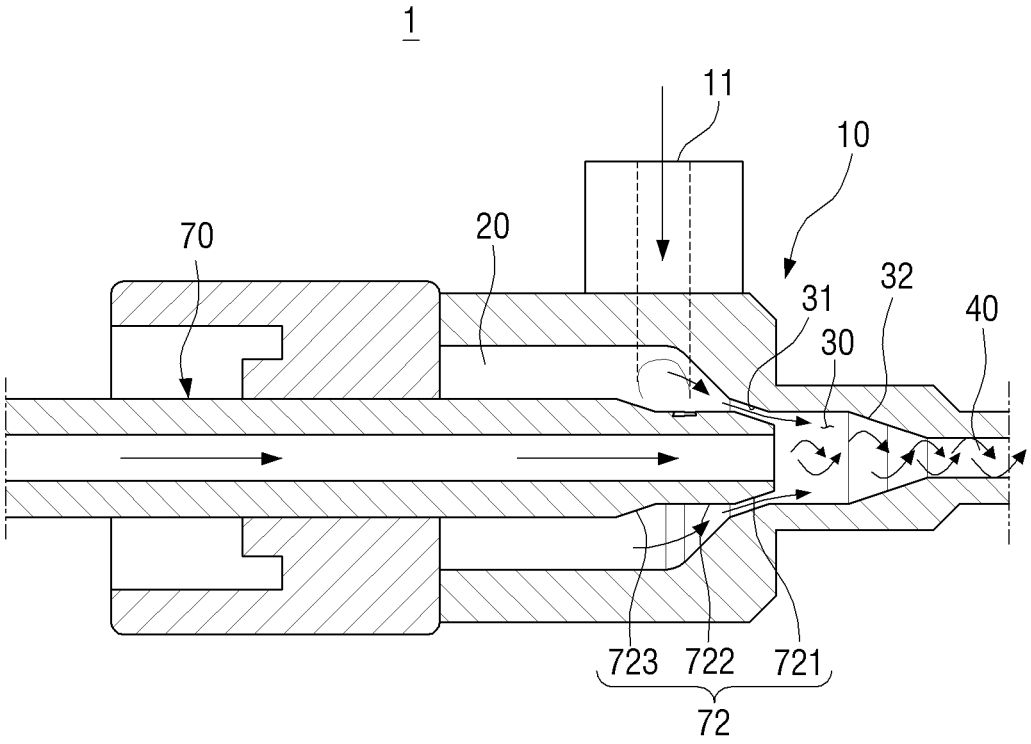
FIGS. 9A, 9B, and 9C are partial cross-sectional views for explaining a pressure drop of three stages in an ejector using a swirl flow according to an embodiment of the present disclosure.
Figure 9B:
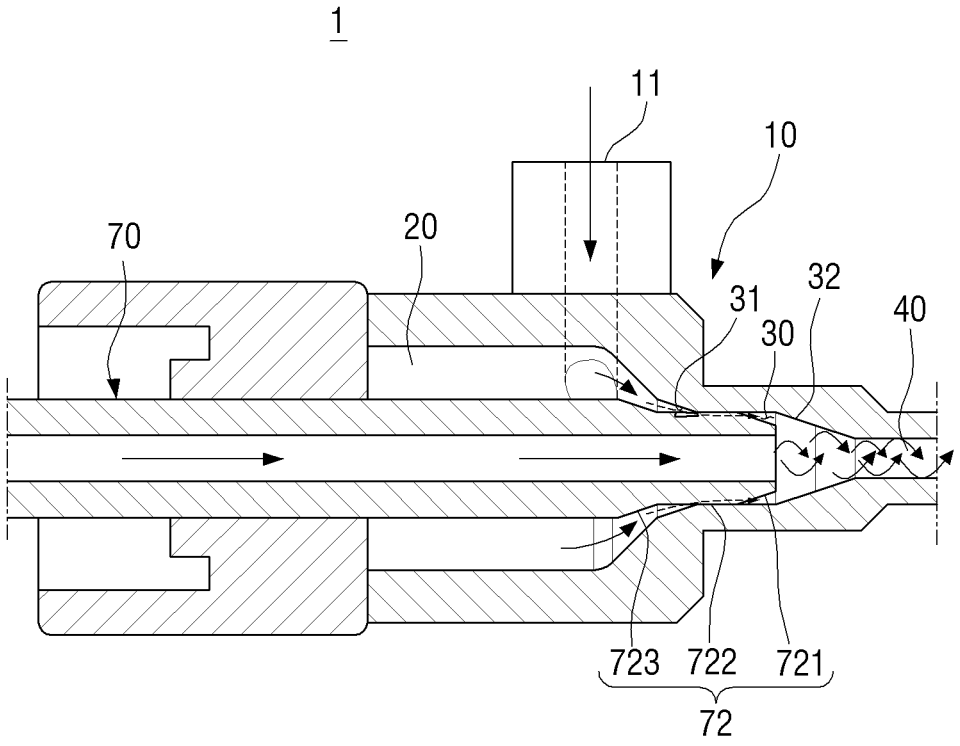
Figure 9C:
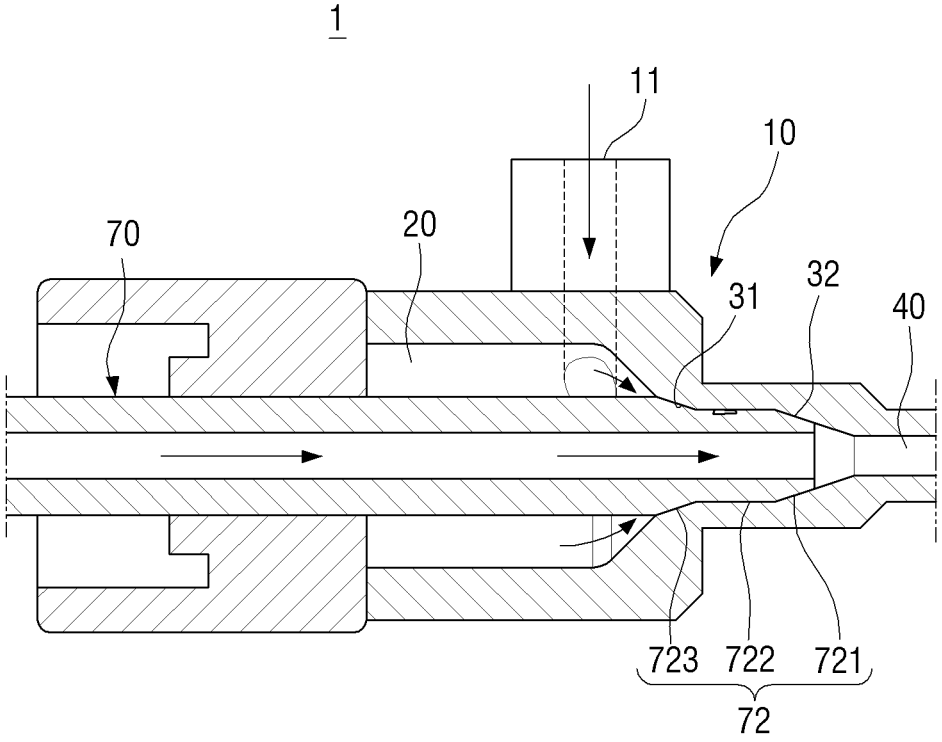

FIGS. 9A, 9B, and 9C are partial cross-sectional views for explaining a pressure drop of three stages in an ejector 1 using a swirl flow according to an embodiment of the present disclosure.

As illustrated in FIG. 9A, when the leading inclined portion 721 of the suction pipe 70 is adjacent to the first slope portion 31 of the nozzle section 30 of the ejector body 10, the main flow may be moved into the nozzle section 30 through the gap between the leading inclined portion 721 of the suction pipe 70 and the first slope portion 31 of the nozzle section 30. Therefore, the flow rate of the main flow flowing from the main flow receiving portion 20 into the nozzle section 30 is reduced. Accordingly, a first pressure drop of the main flow is generated.

When the suction pipe 70 is moved more to the nozzle section 30 so that the leading end portion 72 of the suction pipe 70 is inserted into the nozzle section 30 of the ejector body 10 as illustrated in FIG. 9B, the main flow may be moved to the nozzle section 30 through the plurality of nozzle grooves 720 formed on the leading end portion 72 of the suction pipe 70. Therefore, the flow rate of the main flow is further reduced so that a second pressure drop of the main flow is generated.

Finally, as illustrated in FIG. 9C, when the leading inclined portion 721 of the leading end portion 72 of the suction pipe 70 is in contact with the second slope portion 32 of the nozzle section 30 of the ejector body 10, the plurality of nozzle grooves 720 provided on the leading end portion 72 of the suction pipe 70 is blocked so that the main flow is prevented from moving to the nozzle section 30. Accordingly, a third pressure drop of the main flow is generated.

As described above, when the suction pipe 70 is disposed to be movable with respect to the ejector body 10, change in pressure of the main flow is generated depending on the position of the suction pipe 70. Accordingly, if the controller properly adjusts the position of the suction pipe 70, the pressure of the refrigerant discharged from the ejector 1 may be properly adjusted depending on the outer environment.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

What is claimed is:

1. An ejector using a swirl flow in a vapor compression refrigeration system comprising a condenser and an evaporator, the ejector comprising:

an ejector body including:

a main inlet into which a main flow in high pressure flows, a nozzle section in fluid communication with the main inlet, a mixing portion in fluid communication with the nozzle section, a diffuser in fluid communication with the mixing portion, and a discharge portion in fluid communication with the diffuser, wherein the main inlet is in fluid communication with the condenser, and a suction pipe inserted in a center of the ejector body, the suction pipe including:

a through-hole into which a suction flow in low pressure flows, a leading end portion, an outer surface of which forms a plurality of inclined passages with the nozzle section of the ejector body, the plurality of inclined passages allowing the main flow to be moved to the mixing portion so as to form a swirl flow, wherein the through-hole is in fluid communication with the evaporator, a leading inclined portion which is provided at a leading end of the suction pipe, and a middle inclined portion which is spaced apart from the leading inclined portion, wherein the middle inclined portion has a slope corresponding to a first slope portion of the nozzle section and the leading inclined portion has a slope corresponding to a second slope portion of the nozzle section, wherein the main flow entering through the main inlet of the ejector body and the suction flow entering through the through-hole of the suction pipe are swirled and mixed in the mixing portion of the ejector body, and then are discharged outside through the diffuser and the discharge portion.

2. The ejector using a swirl flow of claim 1, wherein the leading end portion of the suction pipe comprises a plurality of nozzle grooves formed on the outer surface of the leading end portion, and wherein, when the leading end portion of the suction pipe is inserted in the nozzle section of the ejector body, the plurality of nozzle grooves and an inner surface of the nozzle section form a plurality of nozzles, and the main flow is moved to the mixing portion through the plurality of nozzles.

3. The ejector using a swirl flow of claim 2, wherein the plurality of nozzle grooves are formed to be inclined with respect to a center line of the suction pipe.

4. The ejector using a swirl flow of claim 3, wherein the suction pipe is disposed to be movable back and forth with respect to the nozzle section of the ejector body.

5. The ejector using a swirl flow of claim 4, wherein a main flow receiving portion is formed between the main inlet and the nozzle section of the ejector body, the main flow receiving portion has a diameter larger than a diameter of the nozzle section, and is in fluid communication with the main inlet and the nozzle section, and wherein the suction pipe is movable in the main flow receiving portion.

6. The ejector using a swirl flow of claim 5, wherein the nozzle section of the ejector body comprises:

a first slope portion is formed at a portion of the nozzle section which is connected to the main flow receiving portion; and a second slope portion is formed at a portion of the nozzle section which is connected to the mixing portion.

7. The ejector using a swirl flow of claim 6, wherein when the leading inclined portion of the suction pipe is in contact with the second slope portion of the nozzle section, the plurality of nozzle grooves are blocked so that the main flow is not moved to the mixing portion.

8. The ejector using a swirl flow of claim 6, wherein a diameter of the leading end portion of the suction pipe is smaller than a diameter of remaining portions of the suction pipe.

9. The ejector using a swirl flow of claim 5, wherein the main inlet is disposed eccentrically with respect to the center line of the ejector body.

10. The ejector using a swirl flow of claim 2, wherein the plurality of nozzle grooves comprises three nozzle grooves.

11. An ejector using a swirl flow in a vapor compression refrigeration system comprising a condenser and an evaporator, the ejector comprising:

an ejector body including:

a main inlet into which a main flow flows, a nozzle section in fluid communication with the main inlet, a mixing portion in fluid communication with the nozzle section, a diffuser in fluid communication with the mixing portion, and a discharge portion in fluid communication with the diffuser, wherein the main inlet is in fluid communication with the condenser;

a suction pipe disposed to be movable in a lengthwise direction of the suction pipe in a center of the ejector body, the suction pipe including a through-hole into which a suction flow flows, wherein the through hole is in fluid communication with the evaporator, the suction pipe including:

a leading inclined portion which is provided at a leading end of the suction pipe, and a middle inclined portion which is spaced apart from the leading inclined portion, wherein the middle inclined portion has a slope corresponding to a first slope portion of the nozzle section and the leading inclined portion has a slope corresponding to a second slope portion of the nozzle section; and a plurality of nozzle grooves formed on an outer surface of a leading end portion of the suction pipe, the plurality of nozzle grooves that forms a plurality of passages through which the main flow flowing into the main inlet is moved to the mixing portion when the leading end portion of the suction pipe is inserted in the nozzle section of the ejector body, wherein the main flow entering through the main inlet of the ejector body is moved to the mixing portion through the plurality of nozzle grooves so as to form a swirl flow, and is mixed with the suction flow entering through the through-hole of the suction pipe.

12. The ejector using a swirl flow of claim 11, wherein the plurality of nozzle grooves are formed to be inclined with respect to a center line of the suction pipe.

13. The ejector using a swirl flow of claim 11, further comprising:

a support member disposed integrally with the ejector body, the support member supporting movement of the suction pipe, wherein a main flow receiving portion is formed between the support member and the nozzle section, has a diameter larger than a diameter of the nozzle section, and is in fluid communication with the main inlet and the nozzle section.

14. The ejector using a swirl flow of claim 13, wherein the nozzle section of the ejector body comprises, the first slope portion is formed at a portion of the nozzle section which is connected to the main flow receiving portion; and the second slope portion is formed at a portion of the nozzle section which is connected to the mixing portion.

15. The ejector using a swirl flow of claim 14, wherein the plurality of nozzle grooves are formed on at least one of the leading inclined portion and the middle inclined portion of the leading end portion of the suction pipe.

16. The ejector using a swirl flow of claim 11, wherein the nozzle section, the mixing portion, the diffuser, and the through-hole of the suction pipe are arranged in a straight line, and the main inlet is formed such that the main flow flows in a tangential direction with respect to the suction pipe.

17. A vapor compression refrigeration cycle apparatus, comprising:

a condenser;

an evaporator; and an ejector using a swirl flow, wherein the ejector including:

an ejector body comprising a main inlet into which a main flow in high pressure flows, a nozzle section in fluid communication with the main inlet, a mixing portion in fluid communication with the nozzle section, a diffuser in fluid communication with the mixing portion, and a discharge portion in fluid communication with the diffuser, wherein the main inlet is in fluid communication with the condenser; and a suction pipe inserted in a center of the ejector body, the suction pipe including:

a through-hole into which a suction flow in low pressure flows, a leading end portion an outer surface of which forms a plurality of inclined passages with the nozzle section of the ejector body, the plurality of inclined passages allowing the main flow to be moved to the mixing portion so as to form a swirl flow, wherein the through hole is in fluid communication with the evaporator, a leading inclined portion which is provided at a leading end of the suction pipe, and a middle inclined portion which is spaced apart from the leading inclined portion, wherein the middle inclined portion has a slope corresponding to a first slope portion of the nozzle section and the leading inclined portion has a slope corresponding to a second slope portion of the nozzle section, wherein the main flow entering through the main inlet of the ejector body and the suction flow entering through the through-hole of the suction pipe are swirled and mixed in the mixing portion of the ejector body, and then are discharged outside through the diffuser and the discharge portion.

* * * * *